US005784726A

United States Patent [19]

Kay

[11] Patent Number: 5,784,726

[45] Date of Patent: Jul. 28, 1998

[54] TOILET FLAPPER VALVE CONTROL

[76] Inventor: Steven G. Kay, 1432 Brooklyn Blvd., Bay Shore, N.Y. 11706

[21] Appl. No.: 850,194

[22] Filed: May 2, 1997

[51] Int. Cl.[6] ..... E03D 1/14

[52] U.S. Cl. ..... 4/324; 4/403

[58] Field of Search ..... 4/324, 325, 395, 4/403, 404

[56] References Cited

U.S. PATENT DOCUMENTS

| | | | |
|---|---|---|---|
| 3,996,629 | 12/1976 | Riedel | 4/324 |
| 4,032,997 | 7/1977 | Phripp et al. | 4/324 X |
| 4,748,699 | 6/1988 | Stevens | 4/324 |
| 4,937,895 | 7/1990 | Stevens | 4/324 |
| 4,945,578 | 8/1990 | Jomha et al. | 4/391 |
| 5,023,960 | 6/1991 | Ratanagsu | 4/393 |
| 5,031,254 | 7/1991 | Rise | 4/324 |
| 5,142,710 | 9/1992 | Olson | 4/325 |
| 5,185,891 | 2/1993 | Rise | 4/324 |
| 5,205,000 | 4/1993 | Xia et al. | 4/324 |
| 5,464,037 | 11/1995 | Younes | 4/324 X |

*Primary Examiner*—Robert M. Fetsuga
*Attorney, Agent, or Firm*—Collard & Roe, P.C.

[57] ABSTRACT

A method and device for limiting upward movement of a flapper valve in a toilet having an overflow pipe, wherein upon flushing the toilet the flapper valve is raised to a maximum height. The device comprises a spherical body having a bore therethrough with a diameter slightly less than the diameter of the overflow pipe. The method comprises inserting the spherical body onto the overflow pipe and positioning it at a height on the overflow pipe such that upon flushing the toilet, the flapper valve is raised and contacts the spherical body, which prevents the flapper valve from being raised to its maximum height. The device limits the amount of water used with each flush and prevents the flapper valve from becoming stuck in an upright position.

8 Claims, 2 Drawing Sheets

TOILET FLAPPER VALVE CONTROL

BACKGROUND OF THE INVENTION

1. Field of the Invention

This invention relates to a device for use in a toilet tank. In particular, the invention relates to a device and method to prevent the flapper valve from becoming stuck in an upright position during the flushing of a toilet.

2. The Prior Art

The water level of tanks of standard toilet bowls is controlled by a ballcock assembly and ballcock float rod and float ball, or ballcock assemblies without a float rod and float ball, or a toilet fill valve assembly. When the flush lever is depressed, the water drains out of the tank to flush the bowl. During flushing, the flapper or ball valve is raised, causing new water to be pumped in until the flapper ball valve returns to a closed position, and stops the water from exiting the tank. At the same time, water is allowed to continue to fill the tank at the desired height of the float ball of the ballcock assembly, or ballcock assemblies without a float rod and float ball, or toilet fill valve assembly.

The flapper or ball valve is often connected to a chain which is attached to a lever. Depressing the flush handle raises the lever which raises the flapper or ball. Often, when the flapper or ball is fully raised to its highest position, the chain can become kinked or stuck. If this happens, the flapper or ball is kept in a raised position and the water runs into the tank indefinitely, or until the chain is fixed and the valve is closed.

This event can happen almost every time the toilet is flushed, especially if the toilet is old. This problem, in addition to annoying homeowners, causes a large amount of water to be wasted.

There have been several attempts to keep the ball or flapper from becoming stuck and/or to limit the amount of water that flows into the tank. For example, U.S. Pat. No. 3,996,629 to Riedel discloses a flush tank control comprising a sleeve with two extending prongs. The sleeve is slipped over the overflow pipe in the tank and held in place by wing nuts. The prongs extend outward and over the ball or flapper. The chain for the ball or flapper runs in between the prongs. The prongs prevent the ball or flapper from being raised to the full elevation during a flush.

U.S. Pat. No. 5,031,254 to Rise discloses a toilet flush control comprising a stop that is clamped to the overflow pipe in the tank or directly fastened to the flapper valve to prevent the ball or flapper from being raised to its full height. U.S. Pat. No. 5,185,891 to Rise discloses another toilet flush control comprising a height limiting means that is clamped to the overflow pipe.

U.S. Pat. No. 4,945,578 to Jomha discloses a flush control device comprised of two interlocking cups mounted on a sleeve that fits over the overflow pipe. The buoyancy of the cups is adjusted by the position of the cups with respect to each other. When the cups are secured together, the device floats at the top of the water and does not limit the movement of the flapper. When the cups are opened, the device sits lower on the overflow pipe and limits the movement of the flapper.

While these devices are effective in limiting the movement of the flapper and ball valves during flushing, they all suffer from several drawbacks. First, all of the prior art devices are constructed from several parts, any of which can be susceptible to loss or breakage, in addition to being more expensive to manufacture. Second, many of the devices have metal screws and nuts, which are susceptible to rusting inside the toilet tank.

SUMMARY OF THE INVENTION

It is therefore an object of the present invention to provide a device for limiting the movement of the flapper valve in a toilet tank that is simple and inexpensive to manufacture and easy to use.

It is another object of the present invention to provide a device for limiting the movement of the flapper valve in a toilet tank that is made from a single, nonmetallic piece of material.

It is yet another object of the present invention to provide a device for limiting the movement of the flapper valve that can be used on any type of toilet or size of pipe.

It is a further object of the present invention to provide a device for limiting the movement of the flapper valve that can be installed without tools and without altering any of the parts inside the toilet tank.

These and other objects of the invention are accomplished by a device for limiting the movement of a flapper valve in a toilet, comprising a resilient sphere having a bore running therethrough. The bore is sized to fit snugly around the overflow pipe in the toilet tank. However, since the sphere is of a resilient material, several different sized pipes could be fit with a single device. Preferably, the diameter of the bore is slightly less than the diameter of the overflow pipe, so that the device fits snugly around the overflow pipe and does not move from its designated position.

The device is slid down the pipe in the tank to a desired location. The position of the device determines the height that the flapper is allowed to reach. The lower the height of the device, the more the device limits the height of the flapper.

In one preferred embodiment of the device, the device is hollow and made from rubber, synthetic rubber, or other elastomeric, water-resistant material, or a composite of several rubber-like materials or soft plastic materials. In another preferred embodiment of the device, the device is solid and made from styrofoam. In yet another preferred embodiment, the device is a rigid plastic shell having a plurality of holes therethrough to allow for the flow of water therethrough. The holes keep the shell from floating to the top of the tank.

Because the device is constructed from a one-piece, simple shape, there are no stray parts to lose or break, and it is very simple and inexpensive to manufacture. Several different sizes of the device could be made, to fit different sizes of overflow pipes. However, a single device could fit several different types of overflow pipes because of its resilient character.

No disassembly of the toilet is required to install the device. The cover of the toilet tank is merely lifted off, the device slipped down the overflow pipe to a desired position, and the cover is replaced.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
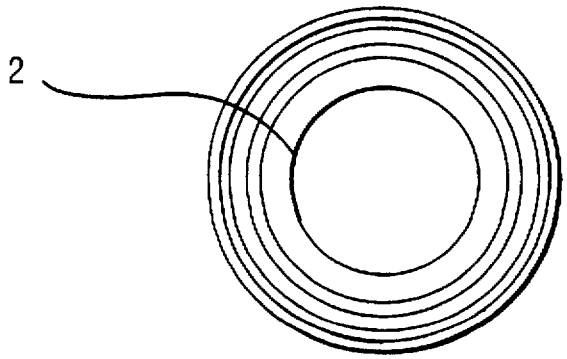
FIG. 1 is a top view of the device according to the invention.

Turning now in detail to the drawings, and in particular, FIG. 1, there is shown a top view of the device 1, having a circular bore 2. Bore 2 is cut or formed to be slightly smaller than the diameter of the overflow pipe for which it is used. Device 1 is made from a resilient material such as rubber so that it can be frictionally retained on the cylindrical surface of the overflow pipe for contact with the flapper valve. It is preferably spherical in shape and may have a solid or hollow interior.

Figure 2:
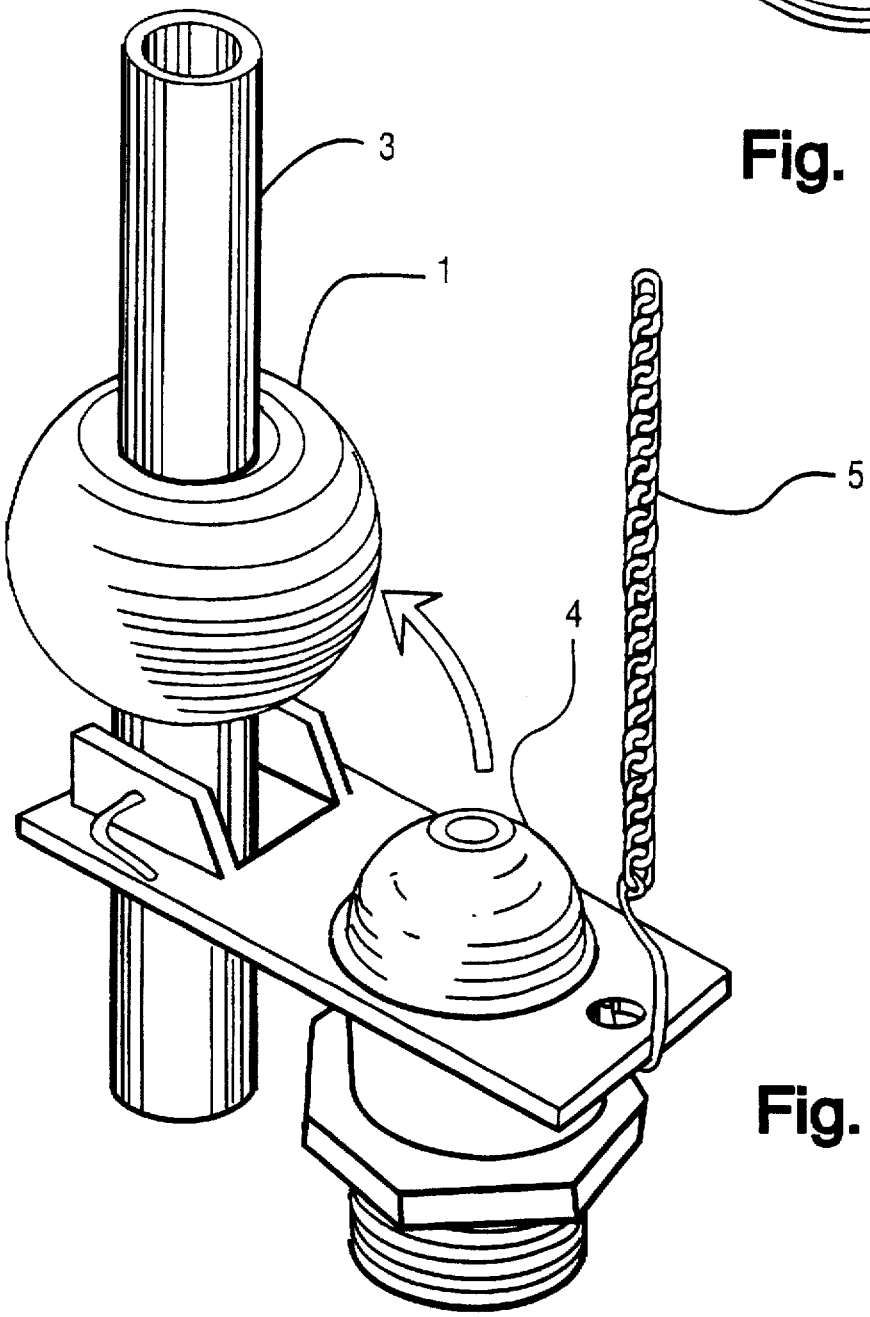
FIG. 2 is a perspective view of the device as it is mounted on an overflow pipe of a toilet.
Figure 3:
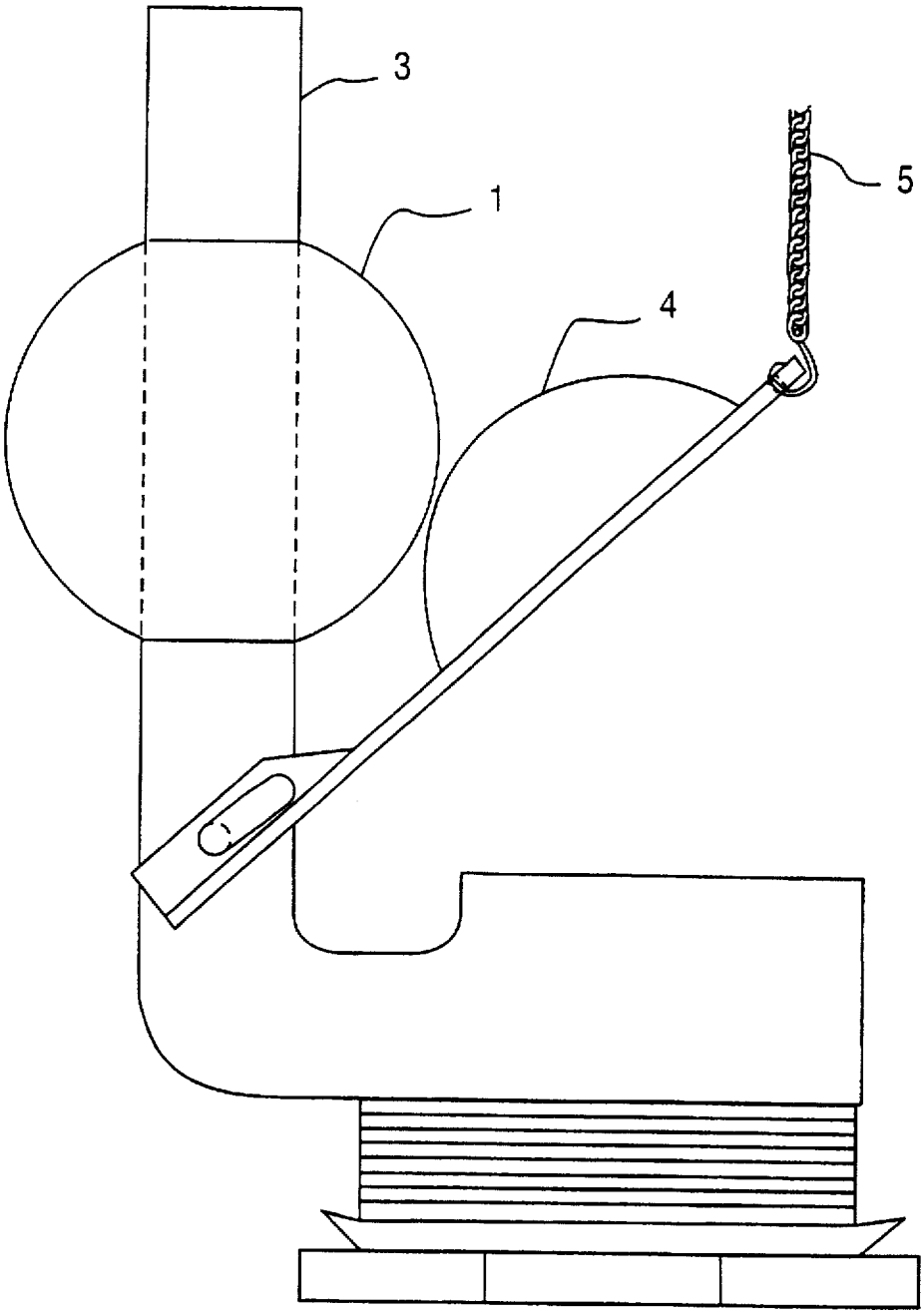
FIG. 3 is a side view of the device showing the flapper valve in a raised position.

As shown in FIG. 2, device 1 is slipped down over the overflow pipe 3 in a toilet to a position near the attachment point of the flapper valve 4. When the toilet is flushed, chain 5 lifts flapper valve 4 up and water is pumped into the tank. As flapper valve 4 is raised up, its top portion contacts device 1 and stops further movement, as shown in FIG. 3. Device 1 is ideally placed so that flapper valve 4 cannot be raised beyond a 45 degree angle. Thus, at its highest point, the flapper valve can never become stuck in an upright position, because the weight of the valve itself will pull it down to the closed position.

FIG. 3 shows device 1 as it prevents flapper valve 4 from being raised beyond a certain angle. As can be seen from looking at FIG. 3, the position of device 1 determines the amount that flapper valve 4 can be raised.

Accordingly, while only several embodiments of the present invention have been shown and described, it is obvious that many changes and modifications may be made thereunto without departing from the spirit and scope of the invention.

What is claimed is:

1. In combination with an overflow pipe of a toilet, a device for limiting upward movement of a flapper valve, wherein upon flushing the toilet the flapper valve is raised to a maximum height, comprising:

a one-piece spherical body having a bore therethrough, said spherical body being inserted over the overflow pipe and positioned for contact with the flapper valve, said bore having a diameter less than the diameter of the overflow pipe, such that said body fits snugly around the overflow pipe and does not move from its position.

2. The device according to claim 1, wherein the body is hollow.

3. The device according to claim 2, wherein the body is made from a material selected from the group consisting of rubber, synthetic rubber, and elastomers.

4. A method for limiting the amount of movement of a flapper valve in a toilet having an overflow pipe, wherein upon flushing the toilet the flapper valve is raised to a maximum height, comprising:

inserting a one-piece spherical body having a bore with a diameter less than the diameter of the overflow pipe onto the overflow pipe; and positioning said spherical body at a location on the overflow pipe such that upon flushing the toilet, the flapper valve is raised and contacts the spherical body, wherein the spherical body fits snugly around the overflow pipe and does not move from its position and wherein the spherical body prevents the flapper valve from being raised to its maximum height.

5. The method of claim 4, wherein the spherical body is hollow.

6. The method of claim 5, wherein the spherical body is made from a material selected from the group consisting of rubber, synthetic rubber, and elastomers.

7. The method of claim 4, wherein the resilient body is positioned to prevent the flapper valve from being raised beyond an angle of 45 degrees.

8. In combination with the overflow pipe of a toilet having a flapper valve, a device for limiting the movement of the flapper valve, wherein upon flushing the toilet the flapper valve is raised to a maximum height, comprising:

a one-piece spherical body having a bore therethrough, wherein said body is made from styrofoam, said spherical body being inserted over the overflow pipe and positioned for contact with the flapper valve, wherein the bore has a diameter less than the diameter of the overflow pipe such that said spherical body fits snugly around the overflow pipe and does not move from its position.

* * * * *